US005366339A

United States Patent [19]

Gould

[11] Patent Number: 5,366,339

[45] Date of Patent: Nov. 22, 1994

[54] LIFTING DEVICE FOR BARRELS

[76] Inventor: Dale Gould, 289 Bedson Street, Winnipeg, Manitoba, Canada

[21] Appl. No.: 61,734

[22] Filed: May 17, 1993

[51] Int. Cl.[5] ..... B66F 9/18

[52] U.S. Cl. ..... 414/607; 294/90; 414/621

[58] Field of Search ..... 414/607, 622, 621; 294/90, 67.3, 106

[56] References Cited

U.S. PATENT DOCUMENTS

| | | | |
|---|---|---|---|
| 2,561,896 | 7/1951 | Weiss | 414/607 |
| 2,827,189 | 3/1958 | Knudstrup | 414/607 |
| 2,842,275 | 7/1958 | Kughler | 414/607 X |
| 2,848,128 | 8/1958 | Thompson | 414/621 |
| 3,438,669 | 4/1969 | Vik | 414/621 X |
| 3,448,880 | 6/1969 | Howard | 414/607 |
| 4,272,220 | 6/1981 | Garcia | 414/621 X |
| 4,718,816 | 1/1988 | King | 414/607 X |
| 5,009,565 | 4/1991 | Esau | 474/607 |

FOREIGN PATENT DOCUMENTS

| | | | |
|---|---|---|---|
| 2639932 | 6/1990 | France | 414/621 |

OTHER PUBLICATIONS

Liftomatic PNC brochure, Liftomatic Material Handling Inc., dated Mar. 12, 1992.

*Primary Examiner*—David A. Bucci

*Attorney, Agent, or Firm*—Adrian D. Battison; Murray E. Thrift; Stanley G. Ade

[57] ABSTRACT

A lifting device for polyethylene barrels comprises a pair of arms each having a sleeve for engaging over the fork of a fork lift truck. A cross bar interconnects the arms and is adjustable in length in conjunction with the adjustment of the spacing between the forks of the fork-lift truck. On the forward end of each end is mounted an arcuate gripper pivotal about a vertical pin on the respective arm. The gripper comprises a horizontal band having a sharpened upper edge with the band curved around a center of the barrel. Each gripper is rotated by a spring in a direction to open forward ends of the gripper to an increased spacing so that the forward ends can be moved forwardly to engage around the barrel and then each gripper pivots about the vertical pin to face the center of the barrel and to engage the barrel under the bead at the upper end of the barrel.

18 Claims, 3 Drawing Sheets

LIFTING DEVICE FOR BARRELS

This invention relates to a lifting device for lifting a barrel.

The supply of product in barrels is becoming more prevalent and particularly the use of polyethylene molded barrels has recently been introduced and become more wide spread. The polyethylene barrel is generally cylindrical with a circular bead at each end to provide strength and stiffening of the ends.

Barrels of this type require handling for loading and transportation of the barrel and for discharge of the materials. The barrels are often difficult to lift individually and in many cases heavy manual labour is used with all of the disadvantages that this entails. Some proposals are made for gripper devices of relatively complex nature requiring hydraulic action to provide compression of the barrel for the lifting action. However there remains an opportunity for manufacture and sale of a relatively simple device which can be manufactured relatively inexpensively and which provides a simple grasping and lifting of a barrel generally using a forklift type lifting system.

According to a first aspect of the invention, therefore, there is provided a lifting device for a barrel comprising a first arm and a second arm, means mounting the arms in parallel spaced substantially horizontal arrangement having a spacing therebetween for receiving a peripheral wall of the barrel therebetween with an axis of the barrel vertical, a pair of grippers for engaging sides of the barrel at positions thereon spaced at 180° around the peripheral wall of the barrel, each gripper comprising an arcuate body arranged to extend around a part only of the peripheral wall of the barrel, means mounting each gripper on a respective arm for pivotal movement about a substantially vertical pivot pin on the arm, the pivot pin being arranged at an intermediate location along the gripper such that a forward part of each gripper projects forwardly of the pin and a rearward part of each gripper projects rearwardly of the pin, and spring means biasing the forward part of the grippers apart to allow the peripheral wall of the barrel to enter therebetween as the arms are moved forwardly to engage the barrel.

According to a second aspect of the invention there is provided a lifting device for a barrel comprising a first arm and a second arm, means mounting the arms in parallel spaced substantially horizontal arrangement having a spacing therebetween for receiving a peripheral wall of the barrel therebetween with an axis of the barrel vertical, a pair of grippers for engaging sides of the barrel wherein each arm includes a sleeve member for engaging around a fork of a fork-lift device such that the arm can be lifted by the fork to carry the barrel.

One embodiment of the invention will now be described in conjunction with the accompanying drawings in which:

DETAILED DESCRIPTION

Figure 1:
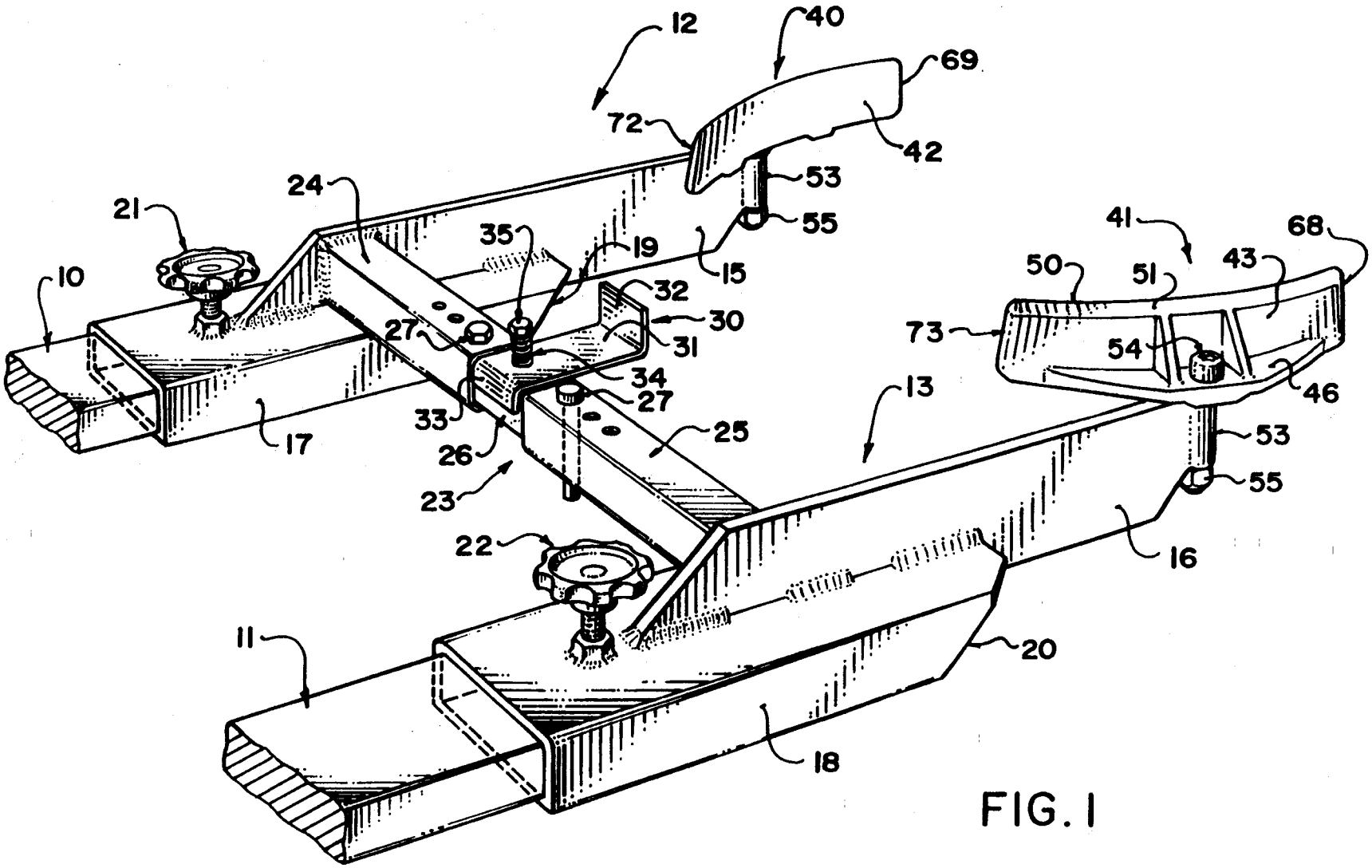
FIG. 1 is an isometric view of the lifting device according to the present invention.

The lifting device of the present invention is designed for attachment to the conventional forks 10 and 11 of a conventional fork lift truck. The truck itself is not illustrated as this is a conventional device and readily available from many different manufacturers. Conventionally the forks comprise a pair of horizontal blades lying in a common horizontal plane with the spacing between the forks being adjustable on the truck by conventional means.

The device comprises generally a first arm 12 and a second arm 13 each of which comprises a vertical plate 15, 16 which is attached to a sleeve portion 17, 18 for engaging over the end of a respective one of the forks 10, 11. Each of the sleeves 17, 18 is generally rectangular in cross section so as to match the cross section of the respective fork and extends to a chamfered outer end 19, 20 again shaped to match the end of the fork so that the fork can be received wholly within the sleeve as a sliding fit. A clamping screw 21, 22 has a hand wheel presented on the top surface of the sleeve and a threaded screw which passes through the top wall of the sleeve for engaging the top surface of the fork.

A cross bar 23 interconnects the arms and is welded to the inside surface of the vertical plate 15, 16. The cross bar includes a pair of sleeves 24 and 25 which are fixedly welded to the vertical plates together with a sliding extension portion 26 which projects into each of the sleeves and fastened thereto by coupling pins 27. The extension portion 26 and the sleeves 24, 25 have a plurality of vertical holes allowing the pins 27 to be positioned in selected ones of the holes when aligned to adjust the length of the cross bar 23. This length adjustment is effected in conjunction with the adjustment of the spacing between the forks to provide a required spacing between the arms to accommodate different diameters of barrel. A stop member 30 is positioned on the extension portion 26 at a central position thereon. The stop member comprises a horizontal plate 31 with an upturned end flange 32. A rear downturned flange 33 extends downwardly behind the extension portion 26. The horizontal plate 31 is held in position flat against the top surface of the tubular extension portion 26 by a spring 34 mounted on a pin 35. This mounting arrangement holds the vertical flange 32 in vertical position between the arms and forwardly of the cross bar 23. However the stop member can be retracted simply by lifting the plate 31 and rotating it about the pin 35 to accommodate larger barrels. The stop member 30 is simply located to prevent a barrel from passing too far between the arms within relatively course tolerances.

Figure 5:
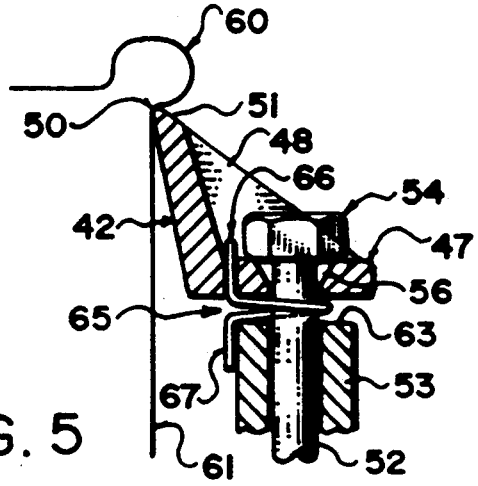
FIG. 5 is a cross sectional view along the lines 5—5 of FIG. 4.

At the forward end of each arm is mounted a respective one of a pair of grippers 40, 41. Each gripper comprises an arcuate plate 42, 43 defining a part cylindrical surface curved about a center 45 and defining a substantially horizontal band for engaging the cylindrical periphery of a barrel. The plate 42.43 is attached to a horizontal flange 46, 47 braced by angle braces 48, 49. The horizontal flange 46, 47 extends outwardly from the rear of the plate 42, 43 at the base of that plate as best shown in FIG. 5. From the flange 47, the plate 42 has a lower surface which is inclined upwardly and inwardly at an angle of the order of 6° to an upper edge 50 for abutting the barrel. From that upper edge 50 the upper surface 51 is inclined downwardly and outwardly to sharpen the upper most edge 50.

The flange 46, 47 is mounted for horizontal pivotal movement about a vertical pin 52 carried in a vertical sleeve 53 welded to an end of the respective arm 15, 16. The pin 52 comprises an upper head 54, a shank and a threaded nut 55 at the lowermost end. This allows the gripper to be loosely clamped to the end of the arm. The pin passes through a hole 56 in the flange 47 with the hole being chamfered or conical in shape to allow some pivotal movement of the flange 47 transverse to the length of the pin. The upper edge 50 can therefore pivot slightly inwardly and outwardly toward or away from the barrel to accommodate differences in curvature between the gripper and the barrel. This also allows the edge 50 to grip up under the top bead 60 surrounding the peripheral wall 61 of the barrel.

Figure 2:
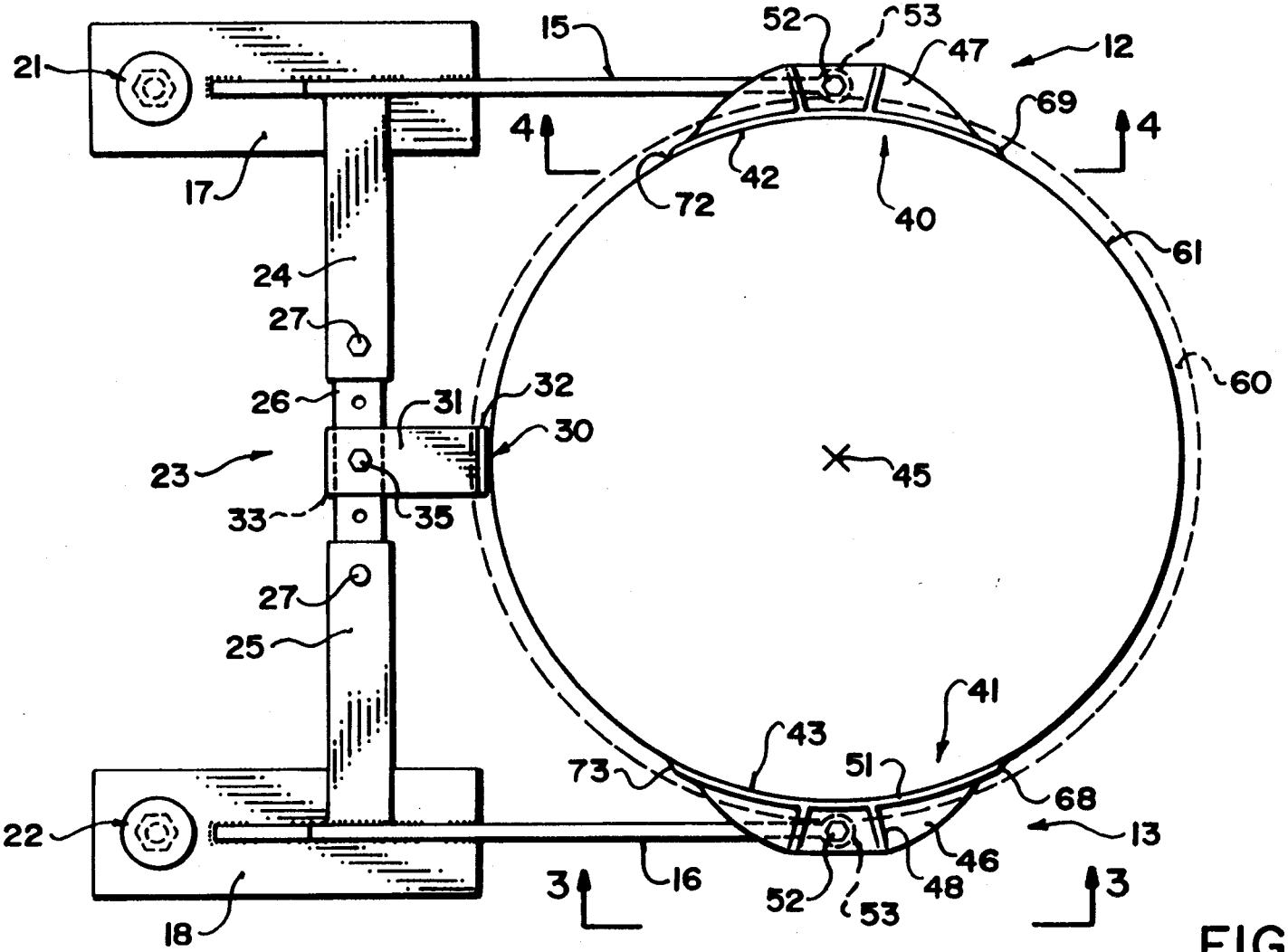
FIG. 2 is a top plan view of the lifting device of FIG. 1.
Figure 3:
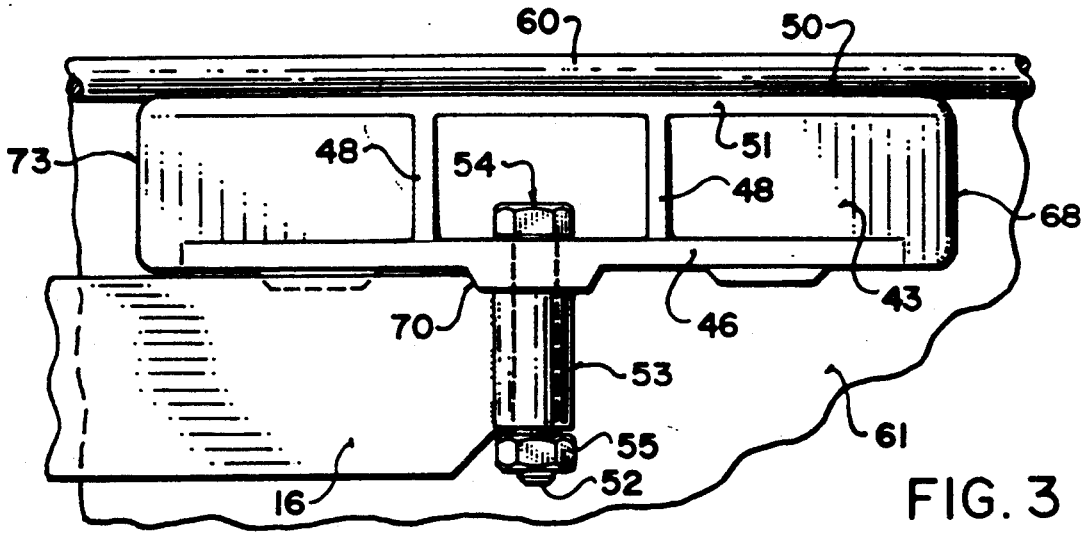
FIG. 3 is a view along the lines 3—3 of FIG. 2.

In a gripping position shown in FIG. 2, therefore, the grippers face inwardly toward the axis 45 of the barrel.

Figure 4:
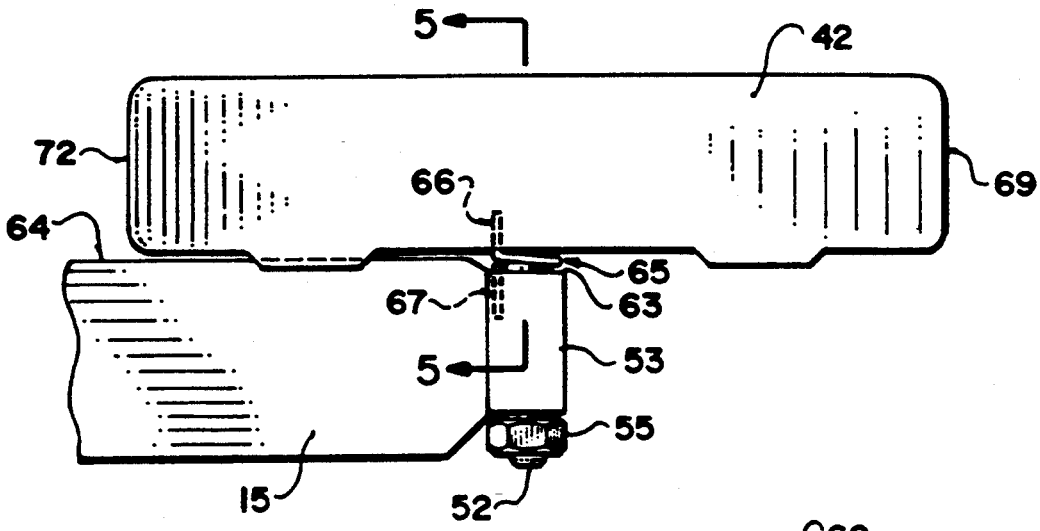
FIG. 4 is a view along the lines 4—4 of FIG. 2.

As best shown in FIGS. 4 and 5, the sleeve 53 has an upper edge 63 spaced downwardly from an upper edge 64 of the respective vertical plate 15, 16. This leaves a shallow space between the under side of the flange 46, 47 and the top edge 63 at which the shank of the pin is exposed. In this area is provided a spring 65 which is wrapped around the pin and has ends 66, 67 engaging the gripper and the arm respectively thus tending to bias the gripper to rotate about the pin. As viewed from the top in FIG. 2, the gripper 41 is rotated by its respective spring in a clockwise direction tending to move a forward end 68 outwardly. Symmetrically the gripper 40 is rotated in a counter clockwise direction intending to move the forward end 69 outwardly. Each gripper has on the outer edge of the respective flange 46, 47 a stop member 70 which limits the amount of movement of the gripper is the biased direction. The stop member 70 engages the outside surface of the vertical plate 15, 16 to limit the amount of movement to a position shown in FIG. 1 in which the forward ends 68 and 69 are presented substantially forwardly that is longitudinally of the arms 12, 13 respectively. This of course rotates the rearward ends 72, 73 of the grippers inwardly.

In use, therefore, the lifting device is moved forwardly by the forklift truck toward a barrel. The height of the lifting device is adjusted by the forklift truck so that the grippers are positioned underneath the bead 60. The forward ends 68 and 69 of the grippers are rotated by the respective springs to a position approximating to the diameter of the barrel after adjustment of the width of the device as previously described. The grippers can therefore move forwardly so that the barrel slides between the forward ends 68 and 69 until the barrel engages the inner surface of the respective gripper and thus tends to rotate the gripper about the respective vertical pin. The grippers are thus moved by the barrel to the position shown in FIG. 2 until the barrel engages the stop member 30 thus preventing further forward movement of the lifting device. In this position, the lifting device can be raised and the upper edge of the grippers engaging under the bead to lift the barrel by the engagement with the bead for transportation of the barrel to a required location. The pivoting action of the grippers about the chamfered hole 56 allows the gripper to tilt slightly inwardly to improve the gripping action. This operation is enhanced by the angle of the inside gripper surface as shown in FIG. 5 to improve the "bite" of the edge 50 into the area under the bead. The grippers are formed from cast metal which provides a rigid structure with relatively close tolerances allowing the gripper to act on a number of different sizes of barrel despite the tact that the curvature of the gripper only matches exactly the curvature of one size of barrel. The use of the device with polyethylene barrels provides an effecting lifting action due to the slight deformation of the polyethylene material of the barrel of which is possible in the gripping action provided by the design as described above.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A lifting device for a barrel comprising a first arm and a second arm, means mounting the arms in parallel spaced substantially horizontal arrangement having a spacing therebetween for receiving a peripheral wall of the barrel therebetween with an axis of the barrel vertical, a pair of grippers for engaging sides of the barrel at positions thereon spaced at 180° around the peripheral wall of the barrel, each gripper comprising an arcuate gripper body arranged to extend around a part only of the peripheral wall of the barrel, means mounting each gripper body on a respective arm for pivotal movement about a substantially vertical pivot pin on the arm, the pivot pin being arranged at an intermediate location along the gripper body such that a forward part of each gripper body projects forwardly of the pin and a rearward part of each gripper body projects rearwardly of the pin, and spring means biasing the forward part of the gripper bodies apart to allow the peripheral wall of the barrel to enter therebetween as the arms are moved forwardly to engage the barrel, each gripper body comprising an inner surface facing an outer wall of the barrel and defining an upper gripper edge at a top of the inner surface and an upper surface extending outwardly relative to the barrel from the upper edge, the inner surface being inclined upwardly and inwardly to the upper edge and the upper surface being inclined outwardly and downwardly from the upper edge to define a sharp edge at the upper edge for engaging under a bead of the barrel, the inner surface and the upper edge extending along the full arcuate extent of the gripper body.

2. The lifting device according to claim 1 wherein each gripper comprises a cast gripper body.

3. The lifting device according to claim 1 wherein each gripper body is mounted on the respective pin for limited pivotal movement transverse to the axis of the pin.

4. The lifting device according to claim 1 including stop means on the gripper for engaging the arm to locate the gripper at a required angular orientation about the vertical pivot pin to present the forward parts of the grippers in displayed outward position.

5. The lifting device according to claim 4 wherein the stop means comprises a projecting lug on a underside of the gripper engaging an upper edge of the arm.

6. The lifting device according to claim 1 wherein each arm comprises a vertical plate having a horizontal top edge on which an under surface of the gripper engages, the vertical pin being received within a vertical sleeve attached to an outer end of the vertical plate, an upper edge of the sleeve being recessed downwardly from an upper edge of the plate to define a space, the spring means being received within the space around the vertical pin at the end of the vertical sleeve.

7. The lifting device according to claim 1 wherein the gripper body includes a horizontal flange having a hole therethrough for receiving the vertical pin, the hole being chamfered upwardly and outwardly to allow limited pivotal movement transverse to the axis of the vertical pin.

8. The lifting device according to claim 1 including means for adjusting the spacing between the arms.

9. The lifting device according to claim 1 including a stop member between the arms for engaging the peripheral wall of the barrel to prevent movement of the barrel longitudinally of the arms beyond the predetermined position.

10. The lifting device according to claim 9 including means for adjusting the position of the stop member.

11. The lifting device according to claim 1 wherein each arm includes a sleeve member for engaging around a fork of a fork-lift device such that the arm can be lifted by the fork to carry the barrel.

12. The lifting device according to claim 11 including clamp means for clamping the sleeve member onto the fork.

13. The lifting device according to claim 11 including a cross bar member extending between the arms, the length of the cross bar member being adjustable to vary the spacing between the arms.

14. A lifting device for a barrel comprising a first arm and a second arm, means mounting the arms in parallel spaced substantially horizontal arrangement having a spacing therebetween for receiving a peripheral wall of the barrel therebetween with an axis of the barrel vertical, a pair of grippers for engaging sides of the barrel at positions thereon spaced at 180° around the peripheral wall of the barrel, each gripper comprising an arcuate body arranged to extend around a part only of the peripheral wall of the barrel, means mounting each gripper on a respective arm for pivotal movement about a substantially vertical pivot pin on the arm, the pivot pin being arranged at an intermediate location along the gripper such that a forward part of each gripper projects forwardly of the pin and a rearward part of each gripper projects rearwardly of the pin, and spring means biasing the forward part of the grippers apart to allow the peripheral wall of the barrel to enter therebetween as the arms are moved forwardly to engage the barrel, each arm comprising a vertical plate having a horizontal top edge on which an under surface of the gripper engages, the vertical pin being received within a vertical sleeve attached to an outer end of the vertical plate, an upper edge of the sleeve being recessed downwardly from an upper edge of the plate to define a space, the spring means being received within the space around the vertical pin at the end of the vertical sleeve.

15. The lifting device according to claim 14 wherein each gripper body comprises an inner surface facing an outer wall of the barrel and defining an upper gripper edge at a top of the inner surface and an upper surface extending outwardly relative to the barrel from the upper edge, the inner surface being inclined upwardly and inwardly to the upper edge and the upper surface being inclined outwardly and downwardly from the upper edge to define a sharp edge at the upper edge for engaging under a bead of the barrel.

16. The lifting device according to claim 14 wherein each gripper body includes a horizontal flange having a hole therethrough for receiving the vertical pin, the hole being chamfered upwardly and outwardly to allow limited pivotal movement transverse to the axis of the vertical pin.

17. A lifting device for a barrel comprising a first arm and a second arm, means mounting the arms in parallel spaced substantially horizontal arrangement having a spacing therebetween for receiving a peripheral wall of the barrel therebetween with an axis of the barrel vertical, a pair of grippers for engaging sides of the barrel at positions thereon spaced at 180° around the peripheral wall of the barrel, each gripper comprising an arcuate gripper body arranged to extend around a part only of the peripheral wall of the barrel, means mounting each gripper body on a respective arm for pivotal movement about a substantially vertical pivot pin on the arm, the pivot pin being arranged at an intermediate location along the gripper body such that a forward part of each gripper body projects forwardly of the pin and a rearward part of each gripper projects rearwardly of the pin, and spring means biasing the forward part of the gripper bodies apart to allow the peripheral wall of the barrel to enter therebetween as the arms are moved forwardly to engage the barrel, wherein each gripper body includes an upwardly extending flange having an upper gripper edge for engaging under a flange of the barrel and a horizontal flange attached to the upwardly extending flange and extending outwardly therefrom, the horizontal flange having a hole therethrough for receiving the vertical pin, the hole being chamfered upwardly and outwardly to allow limited pivotal movement of the gripper body transverse to the axis of the vertical pin.

18. The lifting device according to claim 17 wherein the upper gripper edge is chamfered outwardly and downwardly to define a substantially sharp edge at an inner surface of the gripper body.

* * * * *